US011525275B2

(12) United States Patent
Jung

(10) Patent No.: US 11,525,275 B2
(45) Date of Patent: Dec. 13, 2022

(54) RECONFIGURABLE VACUUM AND SKIMMER ATTACHMENT

(71) Applicant: Scott Jung, Gilbert, AZ (US)

(72) Inventor: Scott Jung, Gilbert, AZ (US)

( * ) Notice: Subject to any disclaimer, the term of this patent is extended or adjusted under 35 U.S.C. 154(b) by 260 days.

(21) Appl. No.: 17/024,416

(22) Filed: Sep. 17, 2020

(65) Prior Publication Data

US 2021/0002914 A1 Jan. 7, 2021

Related U.S. Application Data

(63) Continuation-in-part of application No. 16/040,477, filed on Jul. 19, 2018, now abandoned.

(51) Int. Cl.

| | |
|---|---|
| ***E04H 4/16*** | (2006.01) |
| ***A46B 13/02*** | (2006.01) |
| ***A46B 13/00*** | (2006.01) |

(52) U.S. Cl.

CPC ..... *E04H 4/1645* (2013.01); *A46B 13/001* (2013.01); *A46B 13/02* (2013.01); *A46B 2200/30* (2013.01)

(58) Field of Classification Search

CPC ... E04H 4/1645; E04H 4/1263; E04H 4/1636; A46B 13/001; A46B 13/02; A46B 2200/30; A46B 2200/3073; A46B 13/06

USPC ..... 210/167.1

See application file for complete search history.

(56) References Cited

U.S. PATENT DOCUMENTS

| | | | | |
|---|---|---|---|---|
| 4,402,101 | A * | 9/1983 | van Zyl | E04H 4/1636 15/52.1 |
| 4,454,035 | A | 6/1984 | Stefan | |
| 5,249,324 | A | 10/1993 | Giammanco | |
| 5,614,085 | A * | 3/1997 | Platt, III | E04H 4/1263 210/232 |
| 5,768,734 | A | 6/1998 | Dietrich | |
| 7,451,500 | B2 * | 11/2008 | Baker, Jr. | E04H 4/1272 4/496 |
| 7,686,951 | B2 | 3/2010 | Wagner | |
| 8,869,337 | B2 * | 10/2014 | Sumonthee | E04H 4/1654 15/1.7 |
| 9,399,877 | B2 | 7/2016 | Erlich | |
| 2006/0096905 | A1 * | 5/2006 | Burgassi | E04H 4/1654 210/242.1 |
| 2012/0305498 | A1 * | 12/2012 | Palmer | E04H 4/1272 210/776 |

(Continued)

*Primary Examiner* — Nam X Nguyen
*Assistant Examiner* — Ekandra S. Miller-Cruz
(74) *Attorney, Agent, or Firm* — Michael C. Balaguy

(57) ABSTRACT

A reconfigurable vacuum attachment may include a bell-shaped housing. The bell-shaped housing may have a bell-opening and a hose-interface. The hose-interface may be configured to hydraulically couple with a vacuum hose. A skimmer-plate may be attachable to the bell-opening and include a skimmer-aperture extending through the skimmer-plate. The reconfigurable vacuum attachment may further include a removable brush assembly. The brush assembly may host a rotatable brush coupled to a brush driver. The brush driver may be configured to hydraulically couple with the vacuum hose and convert water flow into a torque and spin the bristles. A buoy may be attached to the housing allowing the reconfigurable vacuum attachment to be used as a pool skimmer. The reconfigurable vacuum attachment is useful for skimming a pool surface and dislodging and vacuuming matter from a pool wall.

1 Claim, 12 Drawing Sheets

(56) References Cited

U.S. PATENT DOCUMENTS

| | | | | |
|---|---|---|---|---|
| 2013/0061407 | A1* | 3/2013 | Ben-Dov | E04H 4/1636 901/1 |
| 2014/0259464 | A1 | 9/2014 | Renaud | |
| 2016/0273238 | A1* | 9/2016 | Heffernan | E04H 4/1618 |

* cited by examiner

RECONFIGURABLE VACUUM AND SKIMMER ATTACHMENT

CROSS-REFERENCE TO RELATED APPLICATION(S)

The present application is related to and claims priority to U.S. Non-Provisional patent application Ser. No. 16/040,477 filed Jul. 19, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of vacuum attachments of existing art and more specifically relates to reconfigurable vacuum attachments.

RELATED ART

Many people own pools, ponds and bodies of water on their property. Residential pools require regular cleaning and sanitation. Swimming pool contaminates are typically introduced by environmental sources. These contaminates include dirt, pollen, leaves, brought in through winds. Further concerns from environmental sources include infectious microorganisms and microscopic algae spores that may be tracked in through creatures such as insects and birds. Although indoor pools may be less susceptible to environmental contaminants, swimmers may be a source of many other pollutants. Pollutants include, dirt, sweat, oil, skin, cosmetics, urine, saliva and fecal matter.

Presently there are few varieties of pool maintenance utilities. Fine meshed nets attached to long poles are used to capture debris floating on a water surface. This method of cleaning the water only captures large particulates that float on the water surface. A finer mesh of netting increases the difficulty a user may experience maneuvering the net in the water. Another common pool maintenance utility is the pool vacuum. The vacuum hose generally has an attachment that is designed to collect dirt and debris from the bottom of the pool. Alternatively, separate attachments are designed to float in a pool to collect debris from the water surface.

U.S. Pat. No. 7,686,951 to Utz Wagner relates to a vacuum skimmer for ponds and the like. The described vacuum skimmer for ponds is a vacuum skimmer for ponds, swimming pools or similar bodies of water having a housing with an intake opening and a dirt collecting container arranged downstream for collecting coarse materials. The water to be purified is sucked in through the dirt collecting container by a pump arranged downstream. The intake opening is provided on one housing side. The vacuum skimmer is movable in such a way that the intake opening upon operation of the vacuum skimmer can orient itself in different directions. The vacuum skimmer has an aeration device by means of which air can be blown into the water.

SUMMARY OF THE INVENTION

In view of the foregoing disadvantages inherent in the known vacuum attachments art, the present disclosure provides a novel reconfigurable vacuum attachment and method. The general purpose of the present disclosure, which will be described subsequently in greater detail, is to provide an efficient and effective reconfigurable vacuum attachment for use.

A reconfigurable vacuum attachment for a pool vacuum is disclosed herein. The reconfigurable vacuum attachment may include a bell-shaped housing. The bell-shaped housing may have a bell-opening and a hose-interface. The hose-interface may include an aperture through the bell-shaped housing. The hose-interface may be configured to hydraulically couple with a vacuum hose. A skimmer-plate may be configured to attach to the bell-shaped housing and 'close' the bell-opening. The skimmer-plate may include a skimmer-aperture extending through the skimmer-plate. The reconfigurable vacuum attachment may further include a brush assembly. The brush assembly may have bristles radially extending from a center axle. The center axle may be coupled to a brush driver. The brush driver may be configured to hydraulically couple with the vacuum hose and convert water flow into a 'torque' (motion) and spin the bristles. A buoy may be attached to the housing to provide a buoyant force when in water. A ballast may be attached to the bell-shaped housing such that the skimmer-aperture is aligned with the surface of the water when the buoy is floating the bell-shaped housing. The reconfigurable vacuum attachment may be useful to vacuum the water surface of a pool and for dislodging, and vacuuming, matter from the pool walls.

According to another embodiment, a method of attaching a reconfigurable vacuum attachment to a pool hose is also disclosed herein. The method of attaching a reconfigurable vacuum attachment to a pool hose includes a providing a reconfigurable vacuum attachment; the reconfigurable vacuum attachment comprising a bell-shaped housing having a front side, a rear side opposite the front side, a top side, and a bottom side opposite the top side, the bell-shaped housing including, an interior surface, an exterior surface, a bell-opening, and a hose-interface, the bell-opening defining the front side of the bell-shaped housing. The hose-interface includes an aperture through the bell-shaped housing; the hose-interface configured to hydraulically couple with the vacuum hose, a skimmer-plate, the skimmer-plate configured to removably couple to the bell-shaped housing, closing off a majority of the bell-opening. The skimmer-plate has a front-face, a rear-face, a left-side, a right-side, an upper-portion, and a lower-portion, the rear-face proximate the bell-opening and facing away towards the rear side of the bell-shaped housing; the skimmer-plate including a skimmer-aperture extending between the front-face and the rear-face, the skimmer-aperture positioned in the upper-portion of the skimmer-plate, and a brush assembly. The brush assembly is configured to rotatably brush the pool wall; the brush assembly including: a brush driver configured to hydraulically couple with the vacuum hose via the hose-interface and to convert water flow into a torque, a center axle coupled to the brush driver such that the torque rotates the center axle about a rotation axis of the center axle. The center axle is configured to rotatably couple to the bell-shaped housing and, a plurality of bristles radially extending from the center axle; the plurality of bristles sized and dimensioned such that a portion of the bristles extend forward of the front side of the bell, and a buoy. The buoy is configured to provide a buoyant force when in water such that the skimmer-aperture floats partially above and partially below the water surface of the pool, the buoy being toollessly couplable to the bell-shaped housing, and a ballast.

The ballast is configured to orient the bell-shaped housing in water when the buoy is coupled to the bell-shaped housing such that the bell-shaped housing lays on its side, with the water surface of the pool intersecting the bell-opening, and such that the top side is directed upward relative to water surface and the bottom side is directed downward toward the pool bottom. The ballast includes at least one weighted member that is denser than water; the ballast removably attached to the bottom side of the bell-shaped housing; and mating the pool vacuum hose to the hose-interface; the method further comprising the optional steps of: inserting the brush assembly into the aperture of the hose-interface; attaching the substantially flat structure of the buoy to the attachment lip of the bell-shaped housing; and affixing the skimmer-plate to the bell-shaped housing.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a reconfigurable vacuum attachment and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a vacuum attachment and more particularly to a reconfigurable vacuum attachment as used to improve the vacuuming of pools.

Generally, the reconfigurable vacuum attachment may be used to clean a pool of leaves, debris, dust, dirt, pollen and other matter from the water of a pool. The vacuum attachment may be sized and dimensioned to attach to an existing pool vacuum hose. Unlike existing pool vacuum attachments, the present invention may be reconfigured to clean both the water surface, and the pool walls. The reconfigurable vacuum attachment may include a flotation attachment, and a dynamic brushing attachment each providing a unique means of cleaning a pool.

The floatation attachment may be coupled to the vacuum attachment housing, allowing the vacuum attachment to be used as a pool skimmer. The vacuum attachment is weighted such that the entire unit may effortlessly maneuvered about the water surface to vacuum floating particulates and debris. When the flotation attachment is removed, the unit may then be used to vacuum the bottom and sides of the pool. An additional brushing attachment is also included for deep cleaning of the pool surfaces. The brushing attachment utilizes the flow of water from the vacuum hose to spin a rotary brush. The bristles of the rotary brush effectively scrub the bottom and walls of the pool to dislodge any foreign matter. The foreign matter is then sucked through the vacuum hose.

Referring now more specifically to the drawings by numerals of reference, there is shown in FIGS. 1-12, various views of a reconfigurable vacuum attachment 100.

Figure 1:
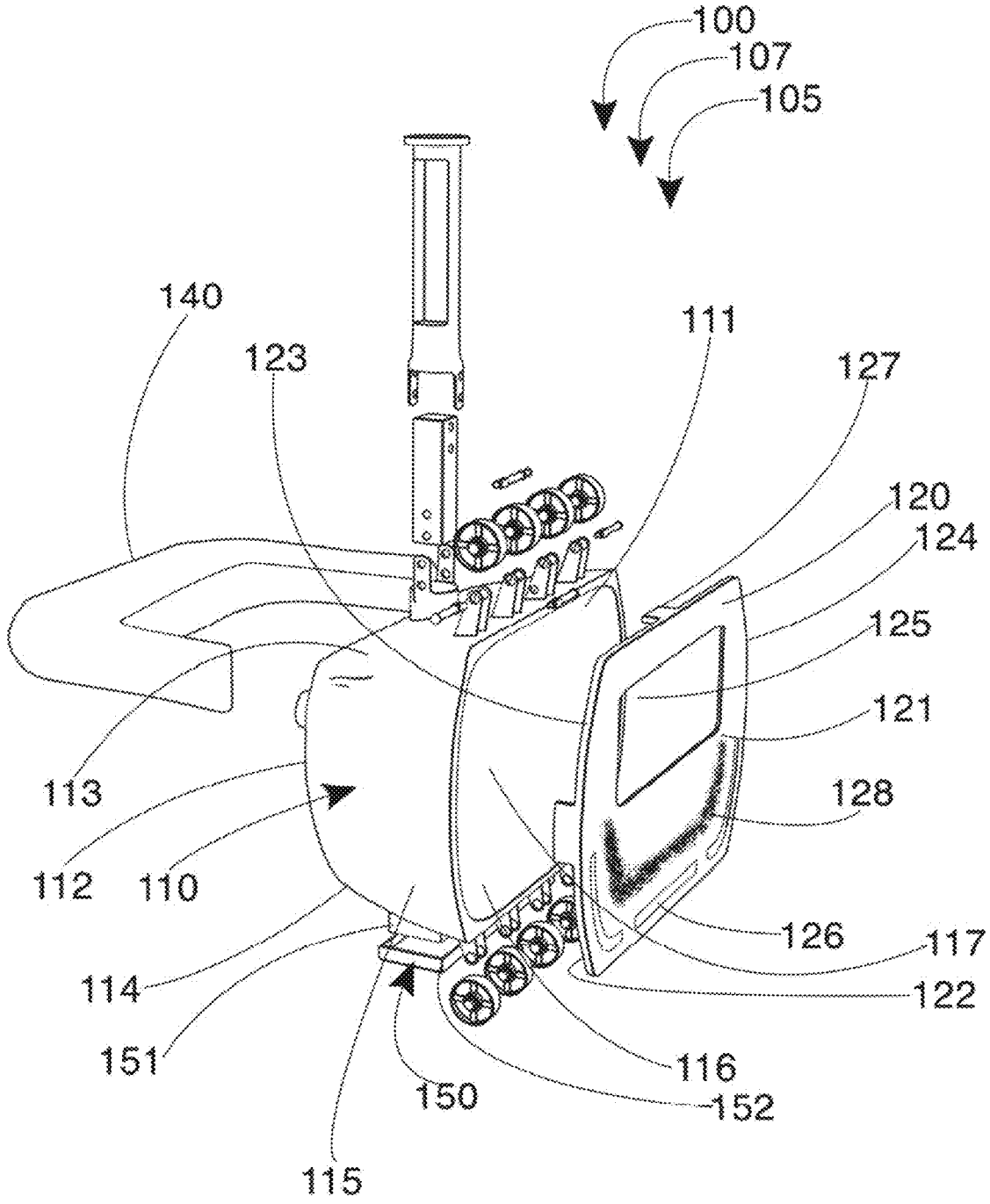
FIG. 1 is an exploded side perspective view of the reconfigurable vacuum attachment during an 'in-use' condition, according to an embodiment of the disclosure.
Figure 2:
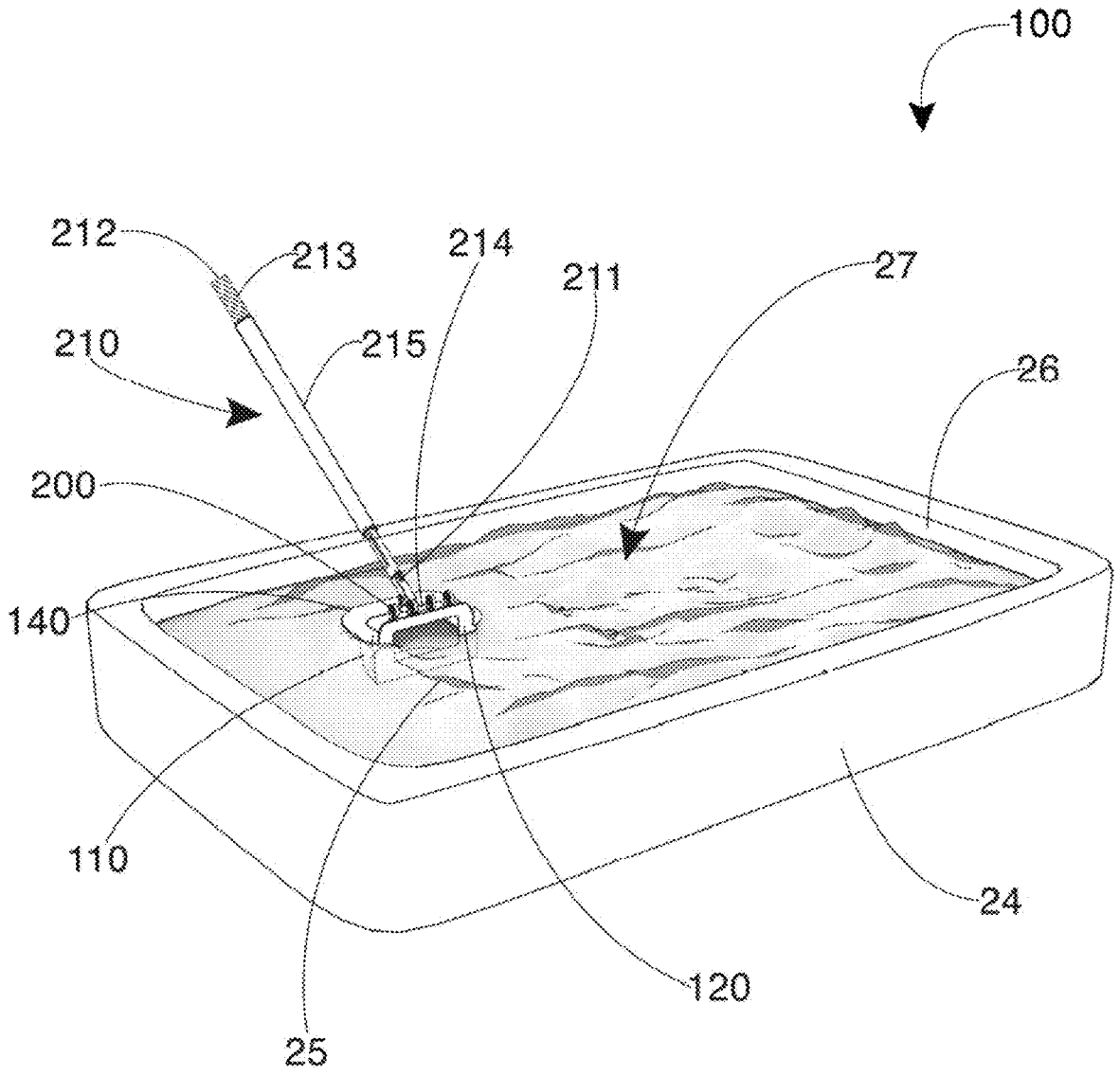
FIG. 2 is a perspective view of the reconfigurable vacuum attachment of FIG. 1, according to an embodiment of the present disclosure.
Figure 4:
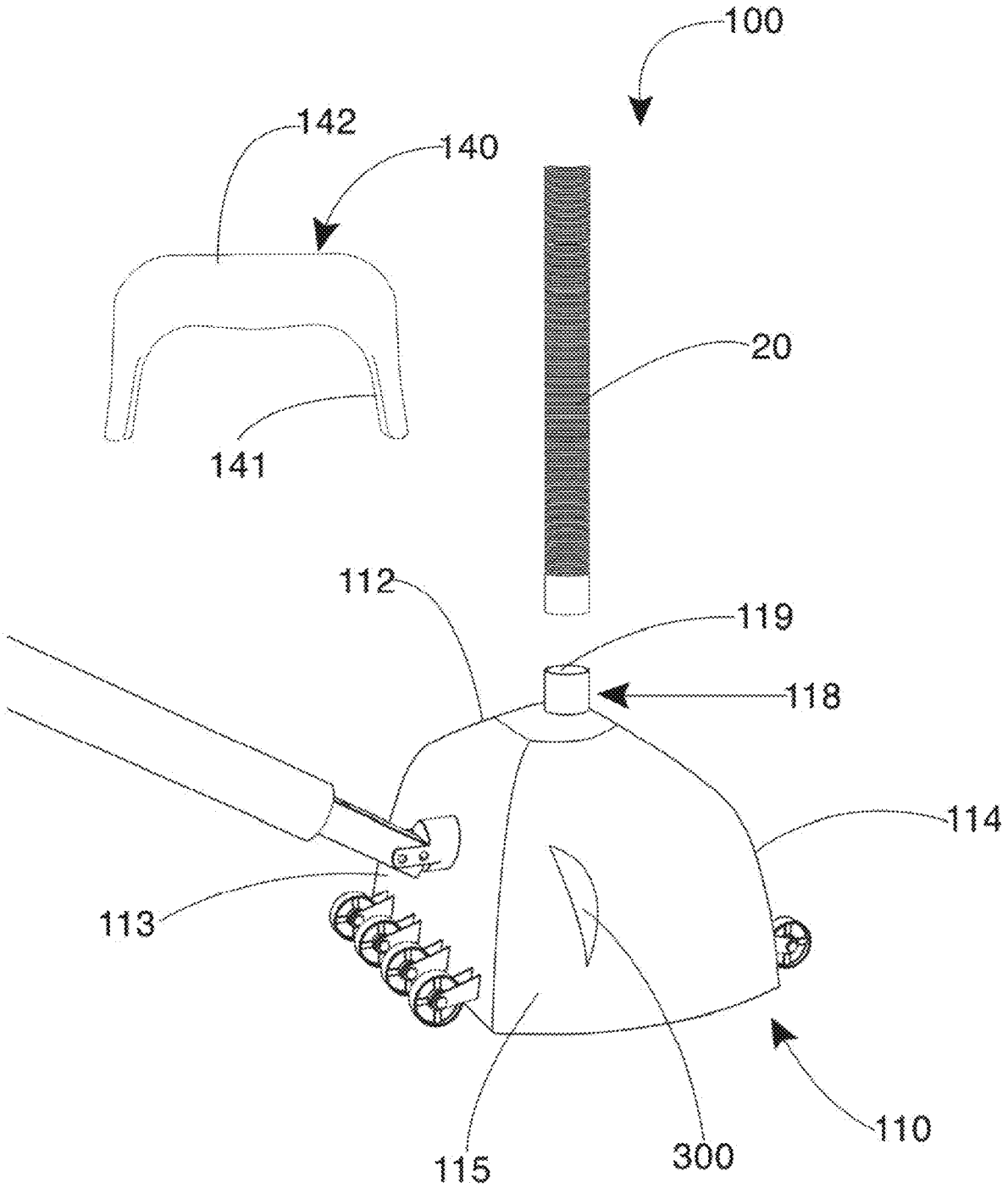
FIG. 4 is a side perspective view of the reconfigurable vacuum attachment of FIG. 1, according to an embodiment of the present disclosure.

FIG. 1 shows a reconfigurable vacuum attachment 100 according to an embodiment of the present disclosure. Here, the reconfigurable vacuum attachment 100 may be beneficial to clean a pool 24 (FIG. 2). As illustrated, the reconfigurable vacuum attachment 100 may include a bell-shaped housing 110 having a front side 111, a rear side 112 opposite the front side 111, a top side 113, and a bottom side 114 opposite the top side 113. The bell-shaped housing 110 may include, an interior surface 116, an exterior surface 115, a bell-opening 117, and a hose-interface 118. The bell-opening 117 defining the front side 111 of the bell-shaped housing 110. The hose-interface 118 (FIG. 4) may include an aperture 119 (FIG. 4) through the bell-shaped housing 110. The hose-interface 118 configured to hydraulically couple with the vacuum hose 20 (FIG. 4).

The skimmer-plate 120 is configured to removably couple to the bell-shaped housing 110, closing off a majority of the bell-opening 117. The skimmer-plate 120 has a front-face 121, a rear-face 122, a left-side 124, a right-side 123, an upper-portion 127, and a lower-portion 126. The rear-face 122 is proximate the bell-opening 117 and faces away towards the rear side 112 of the bell-shaped housing 110. The skimmer-plate 120 may include a skimmer-aperture 125 extending between the front-face 121 and the rear-face 122. The skimmer-aperture 125 positioned in the upper-portion 127 of the skimmer-plate 120. The skimmer-plate 120 may further include a plate-brush 128. The plate-brush 128 may be useful for cleaning the pool wall 26 and the pool bottom 27 of a pool 24.

Figure 3:
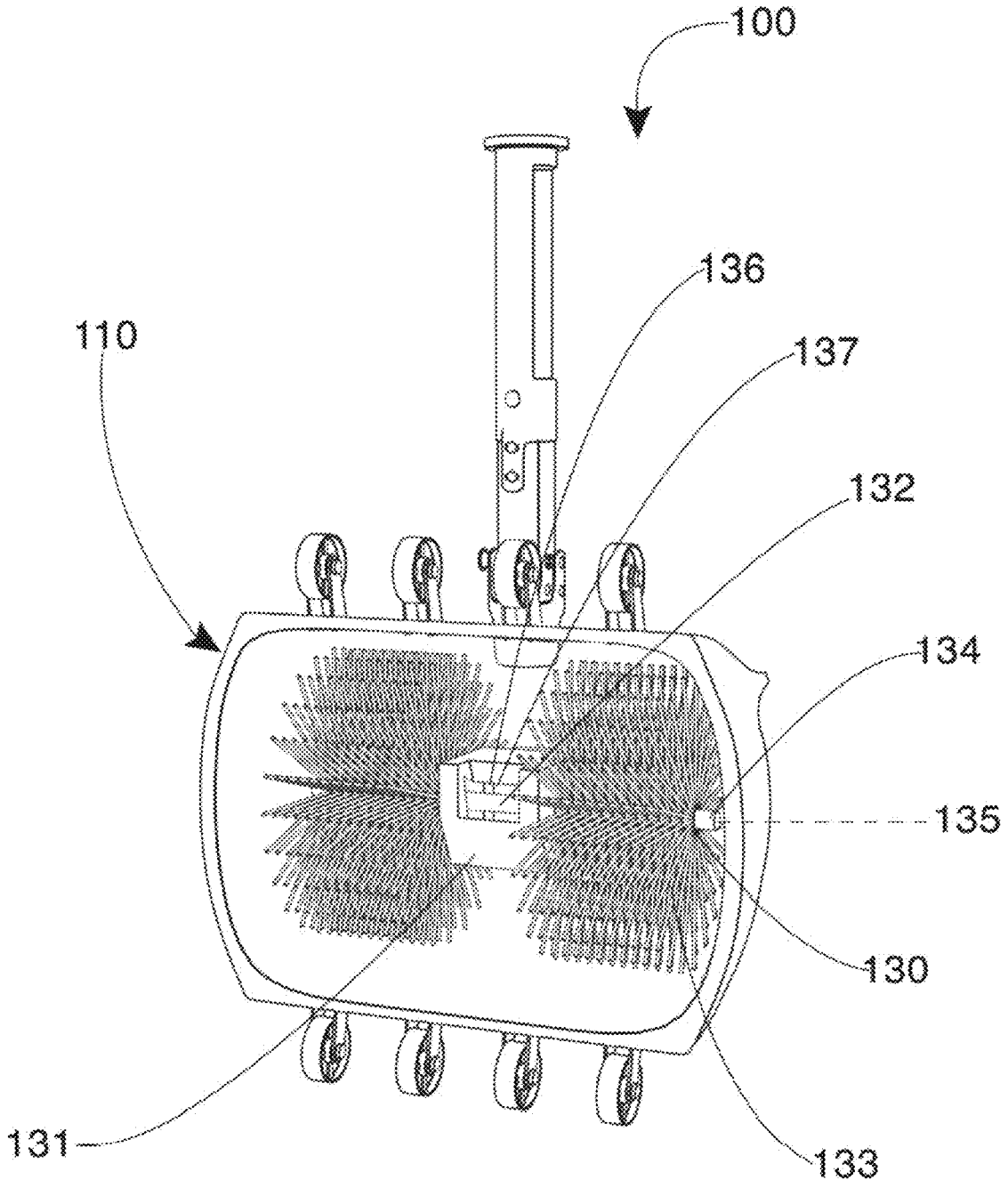
FIG. 3 is a bottom view of the reconfigurable vacuum attachment of FIG. 1, according to an embodiment of the present disclosure.

In FIG. 3 the brush assembly 130 is shown configured to rotatably brush the pool wall 26 (FIG. 2). The brush assembly 130 may include a brush driver 132 (FIG. 3) configured to hydraulically couple with the vacuum hose 20 (FIG. 2) via the hose-interface 118 and to convert water flow into a torque. The brush assembly 130 may include a center axle 134 (FIG. 3) coupled to the brush driver 132 such that the torque rotates the center axle 134 about a rotation axis 135 (FIG. 3) of the center axle 134. The center axle 134 configured to rotatably couple to the bell-shaped housing 110. The brush assembly 130 may include a plurality of bristles 133 (FIG. 3) radially extending from the center axle 134. The plurality of bristles 133 sized and dimensioned such that a portion of the plurality of bristles 133 extend forward of the front side 111 of the bell-shaped housing 110.

The buoy 140 is configured to provide a buoyant force when in water such that the skimmer-aperture 125 floats partially above and partially below the water surface 25 (FIG. 2) of the pool 24 (FIG. 2). The buoy 140 is toollessly couplable to the bell-shaped housing 110.

The ballast 150 is configured to orient the bell-shaped housing 110 in water when the buoy 140 is coupled to the bell-shaped housing 110 such that the bell-shaped housing 110 lays on its side with the water surface 25 (FIG. 2) of the pool 24 (FIG. 2) intersecting the bell-opening 117. The ballast 150 orients the bell-shaped housing 110 such that the top side 113 is directed upward relative to water surface 25 and the bottom side 114 is directed downward toward the pool bottom 27 (FIG. 2). The ballast 150 may include at least one weighted member 151 that is denser than water. The ballast 150 may be removably attached to the bottom side 114 of the bell-shaped housing 110. The ballast 150 may include a weight-cover 152 configured to attach over the at least one weighted member 151, and to the bell-shaped housing 110.

According to one embodiment, the reconfigurable vacuum attachment 100 may be arranged as a kit 105. In particular, the reconfigurable vacuum attachment 100 may further include a set of instructions 107. The instructions 107 may detail functional relationships in relation to the structure of the reconfigurable vacuum attachment 100 such that the reconfigurable vacuum attachment 100 can be used, maintained, or the like, in a preferred manner.

Referring now to FIG. 2 showing the reconfigurable vacuum attachment 100 of FIG. 1, according to an embodiment of the present disclosure. As above, the reconfigurable vacuum attachment 100 may include a bell-shaped housing 110 having a skimmer-plate 120 configured to removably couple to the bell-shaped housing 110, closing off a majority of the bell-opening 117 (FIG. 1). The skimmer-plate 120 may further be configured to fasten to the bell-opening 117. A buoy 140 may be configured to be toollessly couplable to the bell-shaped housing 110. The reconfigurable vacuum attachment 100 may further comprise a plurality of wheels 200. The plurality of wheels 200 configured to position the front-face 121 (FIG. 1) of the skimmer-plate 120 to roll proximate to and along a surface to be cleaned. The plurality of wheels 200 rollably attached to the bell-shaped housing 110. The reconfigurable vacuum attachment 100 may further comprise an extension pole 210. The extension pole 210 may be sized and dimensioned to provide for the bell-shaped housing 110 to be manually maneuvered proximate the pool wall 26. The bell-shaped housing 110 may further include a pole-attachment 214 configured to attach the extension pole 210 to the bell-shaped housing 110. The extension pole 210 may include an insertion end 211 configured to couple with the pole-attachment 214. The extension pole 210 may further include a grip end 213 that includes a user grip 212. The extension pole 210 may further include an elongate member 215 extending between the insertion end 211 and the grip end 213. Further pictured is the pool 24 having a pool bottom 26, a pool wall 27 and, a water surface 25.

FIG. 3 is an underside view of the reconfigurable vacuum attachment 100 of FIG. 1, according to an embodiment of the present disclosure. As shown, the reconfigurable vacuum attachment 100 includes a brush assembly 130 attached to the bell-shaped housing 110. The brush assembly 130 may be separable from the bell-shaped housing 110. The brush assembly 130 may include a brush driver 132 configured to hydraulically couple with the vacuum hose 20 (FIG. 4) via the hose-interface 118 (FIG. 4) and to convert water flow into a torque. The brush driver 132 may include a paddle wheel 136. The brush driver 132 may include an impeller 137. The brush assembly 130 may include a center axle 134 coupled to the brush driver 132 such that the torque rotates the center axle 134 about a rotation axis 135 of the center axle 134. The brush assembly 130 further may include a driver housing 131, and the center axle 134 is further configured to rotatably couple to the driver housing 131. The center axle 134 may be configured to rotatably couple to the bell-shaped housing 110. The brush assembly 130 may include a plurality of bristles 133 radially extending from the center axle 134. The plurality of bristles 133 may be plastic. The plurality of bristles 133 may be metal. The plurality of bristles 133 may be sized and dimensioned such that a portion of the plurality of bristles 133 extend forward of the front side 111 of the bell-shaped housing 110. The brush assembly 130 may further be configured to lock the center axle 134 into a static, non-rotating state.

FIG. 4 is a perspective view of the reconfigurable vacuum attachment 100 of FIG. 1, according to an embodiment of the present disclosure. As shown, the reconfigurable vacuum attachment 100 comprises an exterior surface 115 of the bell-shaped housing 110 that includes an attachment lip 300 configured to couple the buoy 140 to the bell-shaped housing 110. The attachment lip 300 may run between the top side 113 and the bottom side 114 and at least partially extending from proximate the left-side 124 (FIG. 1) of the skimmer-plate 120 (FIG. 1) to the rear side 112 of the bell-shaped housing 110, and back proximate the right-side 123 (FIG. 1) of the skimmer-plate 120. The attachment lip 300 may be used to indicate depth of the vacuum attachment 100 relative to the water surface 25 (FIG. 2) when the buoy 140 is not in use. In one embodiment the buoy 140 may include a substantially flat structure 141 that partially circumscribes the bell-shaped housing 110 and extends away from the exterior surface 115 of the bell-shaped housing 110. In another embodiment, the buoy 140 may include a buoyant-member 142 made preferably of buoyant polyethylene foam. The buoyant-member 142 may be attached to the substantially flat structure 141 for coupling to the attachment lip 300.

Further shown is the hose-interface 118 extending outwardly from the bell-shaped housing 110. The hose-interface 118 having an aperture 119 defining a passage between the interior surface 116 and the exterior surface 115. The hose-interface 118 is configured to couple the reconfigurable vacuum attachment 100 to a vacuum hose 20.

Figure 5:
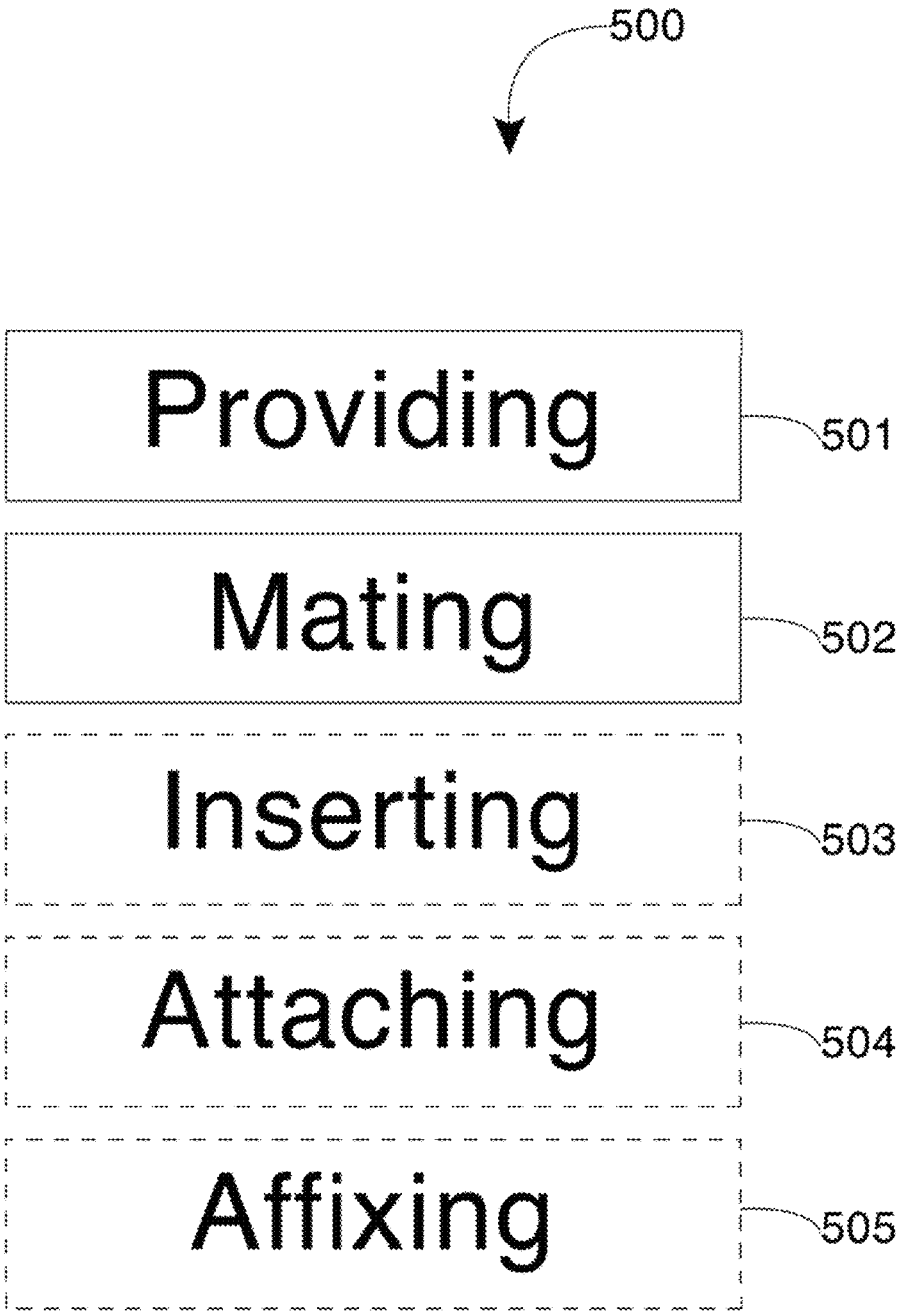
FIG. 5 is a flow diagram illustrating a method of use for attaching a reconfigurable vacuum attachment, according to an embodiment of the present disclosure.

Referring now to FIG. 5 showing a flow diagram illustrating a method for attaching 500 a reconfigurable vacuum attachment 100 to a pool hose, according to an embodiment of the present disclosure. In particular, the method for attaching 500 a reconfigurable vacuum attachment 100 to a pool hose may include one or more components or features of the reconfigurable vacuum attachment 100 as described above. As illustrated, the method for attaching 500 a reconfigurable vacuum attachment 100 to a pool hose may include the steps of: step one 501, providing a reconfigurable vacuum attachment and components as described herein; step two 502, mating the pool vacuum hose to the hose-interface; step three 503, inserting the brush assembly into the aperture of the hose-interface; step four 504, attaching the substantially flat structure of the buoy to the attachment lip of the bell-shaped housing; step five 505, affixing the skimmer-plate to the bell-shaped housing.

It should be noted that steps 503, 504, and 505 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for attaching a reconfigurable vacuum attachment to a pool hose for use, are taught herein.

Figure 6:
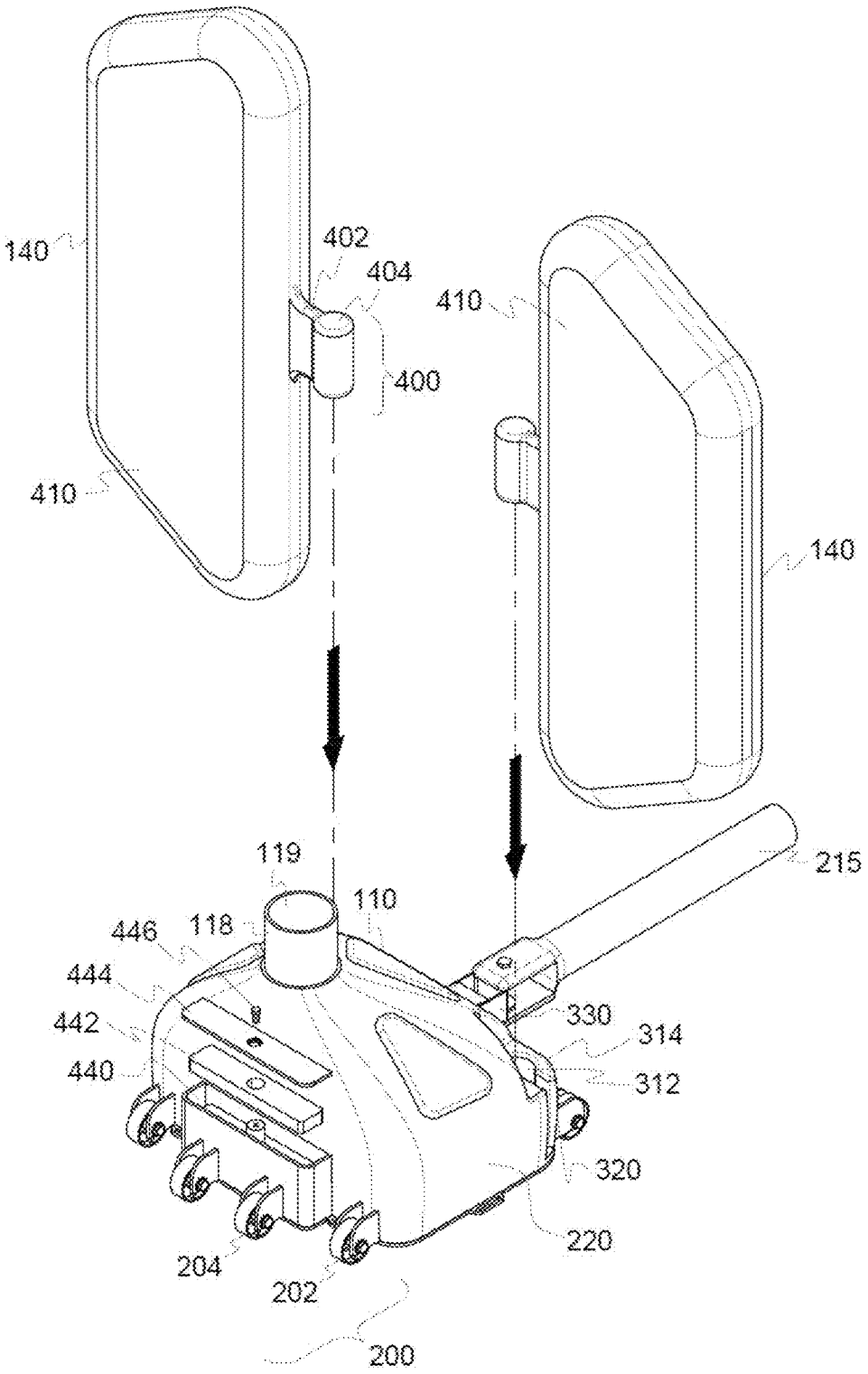
FIG. 6 is a perspective view of a reconfigurable vacuum attachment, according to an embodiment of the present disclosure.

FIG. 6 is a perspective view of an embodiment of the reconfigurable vacuum attachment 100 of FIG. 1, according to an embodiment of the present disclosure. This embodiment is distinguished by a pair of buoys with a friction fastening system and other design details. Vacuum attachment 100 may include bell-shaped housing 110 and two buoys 140 which are removably fastenable to bell-shaped housing 110. Bell-shaped housing 110 has port 119 (previously referred to as aperture), which is able to receive and seal to a vacuum-house. Generally, the vacuum hose may be a flexible plastic hose with a cylindrical interface which slides over the port 119. Accordingly, port 119 may take the external form of a cylindrical neck 118 (previously referred to as hose-interface) extending upwardly out of bell-shaped housing 110, having an external diameter closely matching the internal diameter of the vacuum hose.

Figure 9:
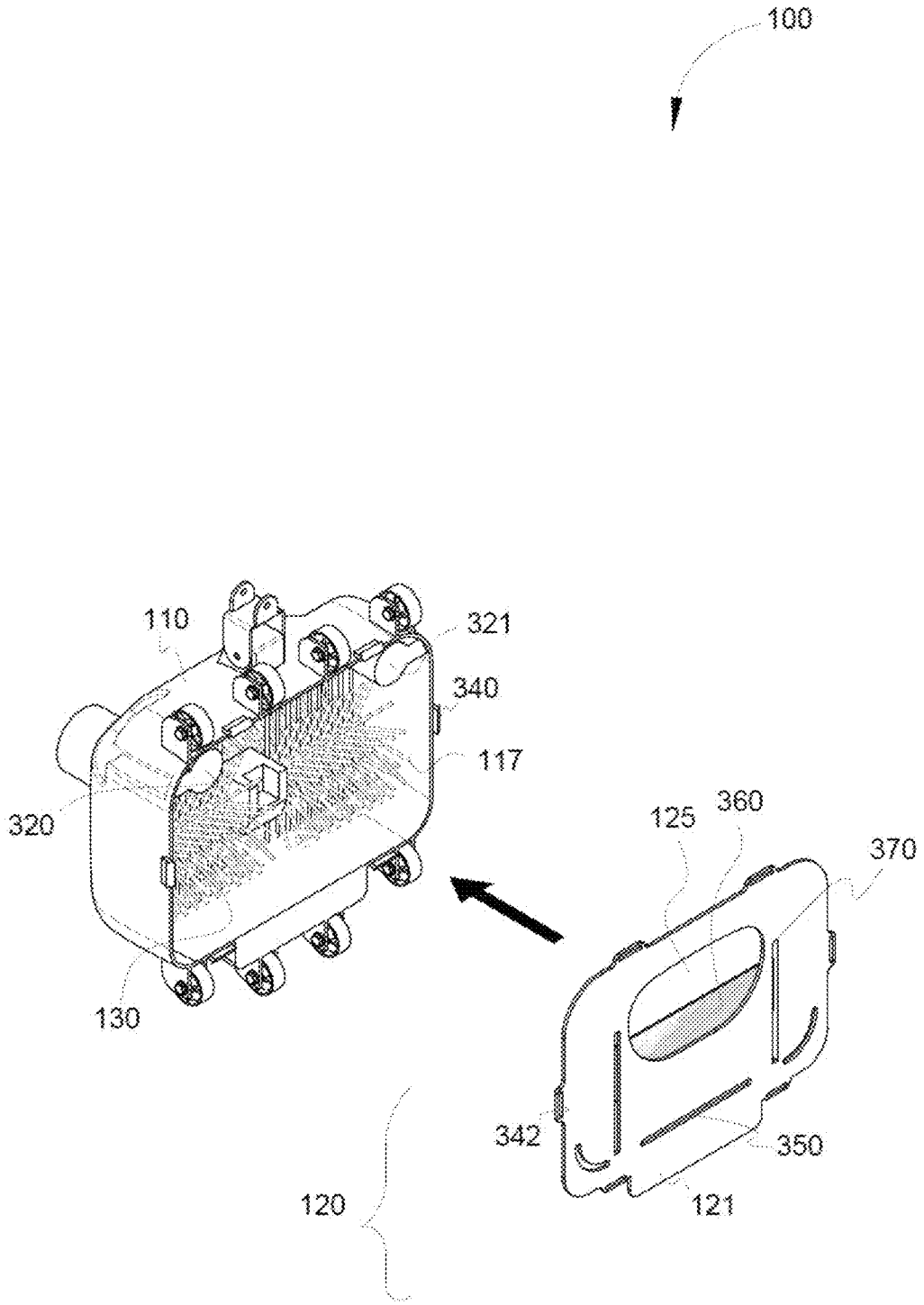
FIG. 9 is a bottom perspective view of the reconfigurable vacuum attachment of FIG. 6 with the faceplate being removed from the bell-shaped housing, according to an embodiment of the present disclosure.

Opposite port 119 may be opening 117 (FIG. 9) (previously referred to as bell-opening). Unlike port 119, opening 117 (FIG. 9) may be as wide as bell-shaped housing 110, fully exposing an interior volume of bell-shaped housing 110. Bell-shaped housing 110 is defined by a sidewall 220 which surrounds the interior volume. In accordance with the bell shape, sidewall 220 narrows from opening 117 (FIG. 9) towards port 119. This narrowing, tapering, or curvature funnels water and debris taken in from opening 117 (FIG. 9) into port 119. Port 119 may be aligned upon an axis which passes through opening 117 (FIG. 9). This geometry is advantageous because no corners or choke points impede debris from reaching port 119, reducing incidents of impaction.

Figure 7:
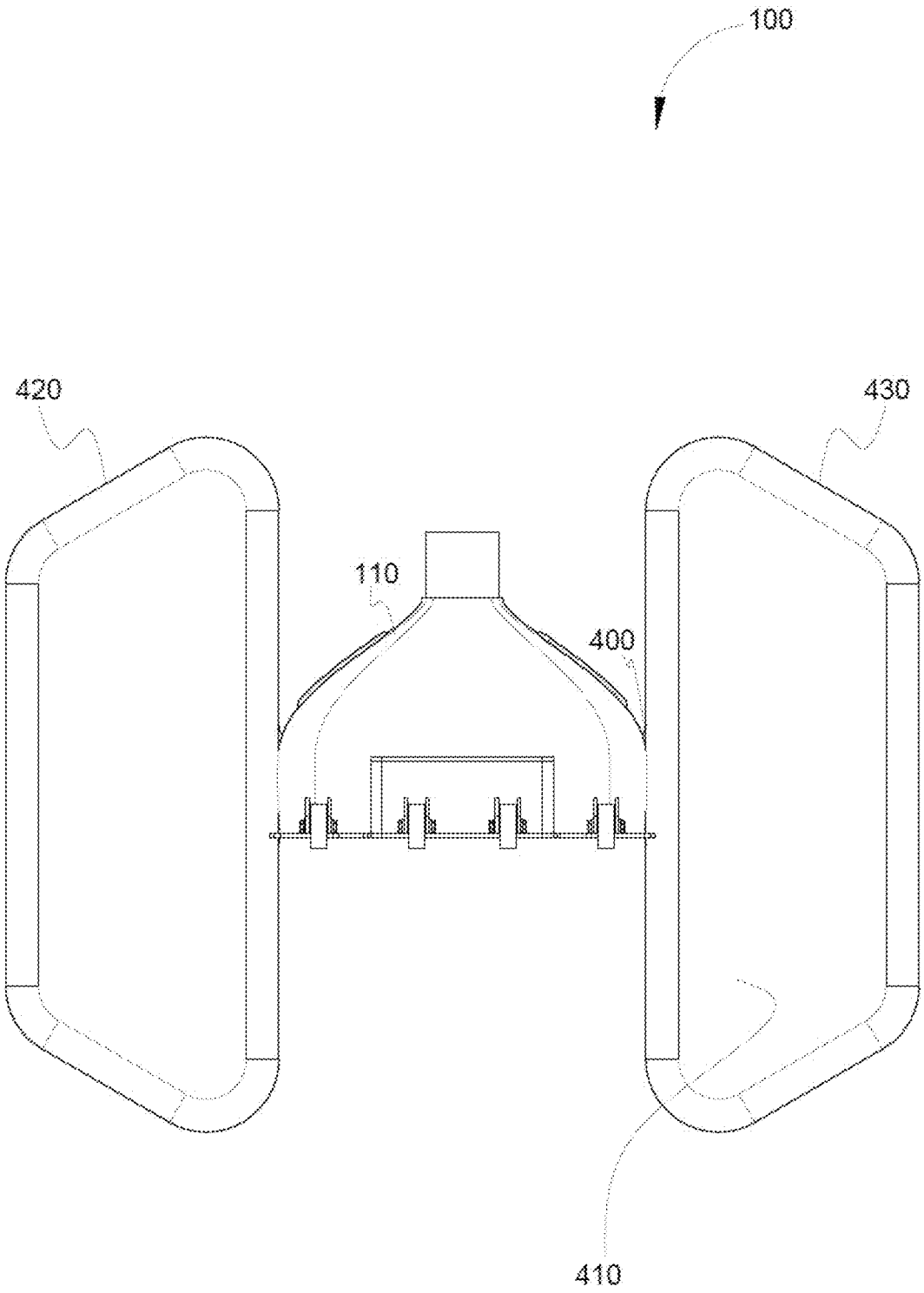
FIG. 7 is a top view of the reconfigurable vacuum attachment of FIG. 6, according to an embodiment of the present disclosure.

Exteriorly, bell-shaped housing 110 may include left-receiver 321 (FIG. 9) and right-receiver 320 embedded within sidewall 220. Left-receiver 321 and right-receiver 320 mirror each other on either side of opening 117 (FIG. 9), and function as attachment points for the two buys 140 (FIG. 7).

Vacuum attachment 100 may also include at least one weight 442. Correspondingly, bell-shaped housing 110 may also include weight-receptacle 440, which is able to contain at least one weight 442. Further, bell-shaped housing 110 may also include cap 444, which able to close weight-receptacle 440. Preferably, weight-receptacle 440 is located on an exterior of sidewall 220, so that it is accessible for servicing by a user without disassembling bell-shaped housing 110. Weight-screw 446 may be provided as well and may be able to pass through cap 444 and at least one weight 442 to fasten cap 444 and at least one weight 442 to weight-receptacle 440.

Wing 400 may be able to fasten the buoy 140 to either of left-receiver 321 (FIG. 9) and right-receiver 320. Each of left-receiver 321 (FIG. 9) and right-receiver 320 may include cylindrical bore 314 and rectangular slot 312, which intersects an exterior of sidewall 220 at one end and cylindrical bore 314 at the other end. Wing 400 may include cylindrical lobe 404 which is able to pass into cylindrical bore 314 as well as rectangular cantilever 402 affixing cylindrical lobe 404 to buoy-body 410, such that rectangular cantilever 402 may be sufficiently narrow to pass through rectangular slot 312. At least one of cylindrical lobe 404 and rectangular cantilever 402 is sufficiently wide to friction-fit wing 400 into either of left-receiver 321 and right-receiver 320 and retain the buoy to bell-shaped housing 110.

Vacuum attachment 100 may also include plurality of wheels 200. Plurality of wheels 200 may be divided into primary-wheels 204 and secondary-wheels 202 as shown. Secondary wheels may be recessed back closer to opening 117 (FIG. 9) such that they only engage with a surface when opening 117 is flat, adjacent to the surface which vacuum attachment 100 is riding upon. When vacuum attachment 100 is tilted, only primary-wheels 204 are able to remain in contact with the surface. Bell-shaped housing 110 may also have a plurality of tangs affixed exteriorly to and projecting outwardly from sidewall 220, which are able to accept and support plurality of wheels 200. Each of plurality of wheels 200 may be able to rotate freely within the plurality of tangs. Plurality of wheels 200 may include a first-set of wheels arrayed on one side of bell-shaped housing 110 and a second-set of wheels arrayed on an opposite side of bell-shaped housing 110.

Yet further, bell-shaped housing 110 may also have a handle-mount. Correspondingly, vacuum attachment 100 may include handle 215. At least one U-joint 330 may mechanically connect handle 215 to bell-shaped housing 110. U-joint 330 may have two points of articulation (which fulcrum pins angularly separated by ninety degrees) so that bell-shaped housing may be rotated a full three-hundred and sixty degrees merely by turning handle 215.

FIG. 7 is a top view of the reconfigurable vacuum attachment 100 of FIG. 1, according to an embodiment of the present disclosure. As illustrated, two buoys may be attachable to bell-shaped housing 110. Each of left-buoy 420 and right-buoy 430 may be constructed of buoy-body 410 and wing 400 (FIG. 6).

Figure 8:
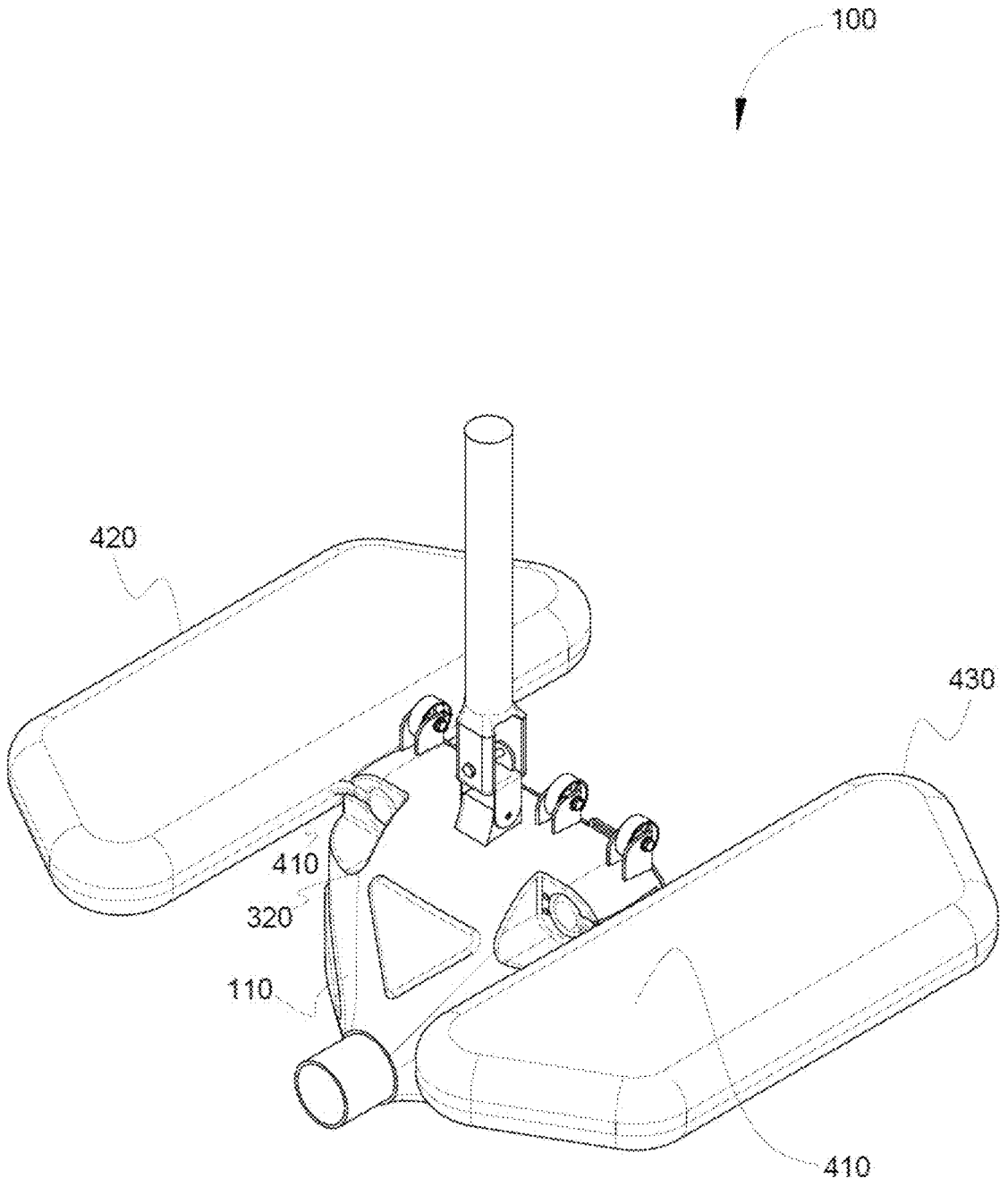
FIG. 8 is a top perspective view of the reconfigurable vacuum attachment of FIG. 6, according to an embodiment of the present disclosure.

FIG. 8 is a top perspective view of the reconfigurable vacuum attachment 100 of FIG. 1, according to an embodiment of the present disclosure. As illustrated, buoy-bodies 4010 of each of left-buoy 420 and right-buoy 430 may include a flat trapezoidal face configured to level the buoy 140 with a water surface when vacuum attachment 100 is set in water. Wing 400 is positioned centrally relative to the flat trapezoidal face. As before, each wing 400 affixes each buoy-body 410 to each receptacle 320 and 321 (FIG. 9) of bell-shaped housing 110. In this way, the flat trapezoidal shape of left-buoy 420 and right-buoy 430, and the buoyancy of those bodies, maintains bell-shaped housing 110 in an upright positioning in the water, such that opening 117 (FIG. 9) remains level with the surface of the water.

FIG. 9 is a bottom perspective view of the reconfigurable vacuum attachment 100 of FIG. 1 with faceplate 120 being removed from bell-shaped housing 110, according to an embodiment of the present disclosure. Faceplate 120 may be able to fasten to and close over the opening 117. Faceplate 120 may have planar face 121 (previously referred to as front-face), which is substantially flat and smooth. Intake-aperture 125 may perforate faceplate 120 and may enable fluid to enter bell-shaped housing 110. In tandem, at least one auxiliary-aperture 350 perforating faceplate 120 may also enable fluid to enter bell-shaped housing 110, though preferably at a lesser rate. Slots 370 may run along intake-aperture 125 on either side to enact adjustment of positioning of door 360. At least one auxiliary-aperture 350 serves to balance the intake of water geometrically across the cross-section of opening 117 and prevent cavitation and air bubbles within bell-shaped housing 110. It has been found experimentally that the inclusion of auxiliary-aperture 350 (especially in the illustrated configuration, which will be expounded upon in FIG. 10) significantly improves the intake flow from faceplate 120 to port 119 (FIG. 6), and improves constant suction applied to vacuum attachment 100 from a remote vacuum. Door 360 may be able to selectively close, partially close, and open intake-aperture 125, such that a user may adjust how much water flow may enter bell-shaped housing 110 through faceplate 120. Such adjustability is important to tune vacuum attachment 100 to vacuums of different power ratings. For example, a high horsepower vacuum may cause excessive intake of air and cavitation of the door is mostly closed, because water cannot flow to port 119 (FIG. 6) quickly enough. Accordingly, a user may open door 360 wider for more powerful vacuums, and reduce the size of intake-aperture 125 for less powerful vacuums.

Yet further, faceplate 120 further comprises at least one longitudinal-slot 342 to serve as a fastening-receiver. Bell-shaped housing 110 may further include at least one clip 340 able to fasten to the at least one longitudinal slot 342 and thereby retain faceplate 120 to bell-shaped housing 110. Preferably, at least one clip 340 has an inclined ridge and is sufficiently flexibly to bend when forced into at least one longitudinal-slot 342 and then snap over faceplate 120 on the other side to retain faceplate 120 to bell-shaped housing 110. Also illustrated is the underside of right-receiver 320 and left-receiver 321.

In some embodiments, bell-shaped housing 110 may also include cleaning assembly 130 having center axle 134 (FIG. 3) able to rotate within bell-shaped housing 110. Plurality of bristles 133 (FIG. 3) may radially extend from the center axle 134 (FIG. 3), the plurality of bristles 133 (FIG. 3) sized and dimensioned such that a portion of the bristles 133 (FIG. 3) extend forward of the front side of the bell-shaped housing 110 when faceplate 120 is detached from bell-shaped housing 110.

Figure 10:
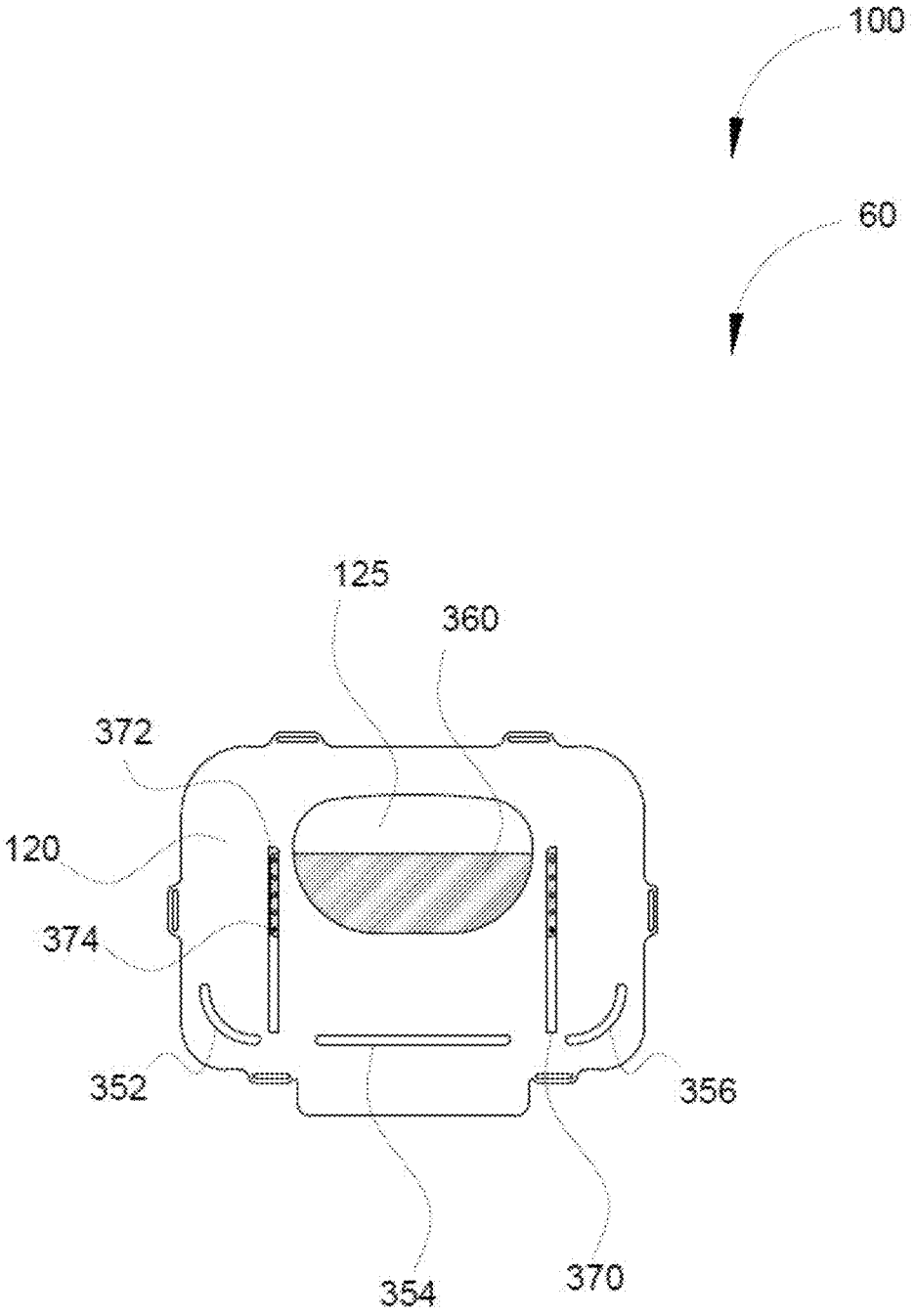
FIG. 10 is a perspective view of the reconfigurable vacuum attachment of FIG. 6 with the door in a maximally-closed position, according to an embodiment of the present disclosure.

FIG. 10 is a perspective view of the reconfigurable vacuum attachment 100 of FIG. 1 with door 360 in a maximally-closed position 60, according to an embodiment of the present disclosure. Faceplate 120 further comprises pair of tracks 376 having sufficient relief to enable door 360 to slide linearly within the pair of tracks 376, pair of tracks 376 retaining door 360 to faceplate 120. Door 360 may also include plurality of detent-apertures 372 which overlap each of the pair of tracks 376 in each slot 370. Each of the pair of tracks 376 may include detent 374 able to penetrate into each of plurality of detent-apertures 372 when one of plurality of detent-apertures 372 aligns with detent 374. Detent 374 is not so protrusive that detent-apertures 372 cannot be snapped out of engagement with detent 374. At least one auxiliary-aperture 350 (FIG. 9) may include first-corner port 352, second-corner port 356, and center-port 354 disposed between first-corner port 352 and second-corner port 356. First-corner port 352 and second-corner port 356 may each take the form of a curved slot, and center-port 354 may take the form of a linear slot. Preferably, the edges and corners of the slots are rounded, as illustrated.

Figure 11:
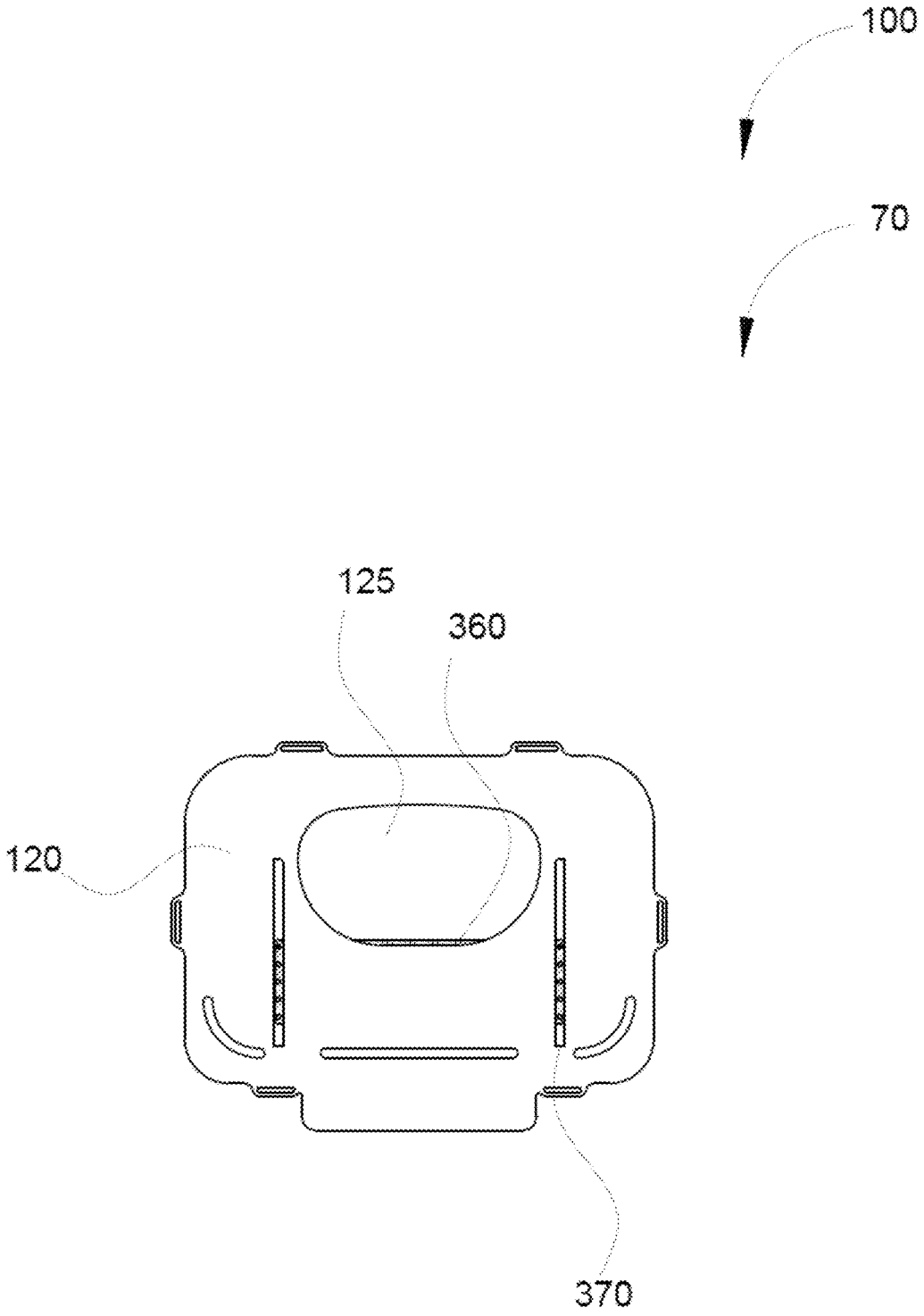
FIG. 11 is a perspective view of the reconfigurable vacuum attachment 100 of FIG. 6 with the door in a maximally-open position, according to an embodiment of the present disclosure.

FIG. 11 is a perspective view of the reconfigurable vacuum attachment 100 of FIG. 1 with door 360 in a maximally-open position 70, according to an embodiment of the present disclosure. As before, door 360 partially closes intakes-aperture 125 of faceplate 120, and the positioning of door 360 is adjustable via slots 370.

Figure 12:
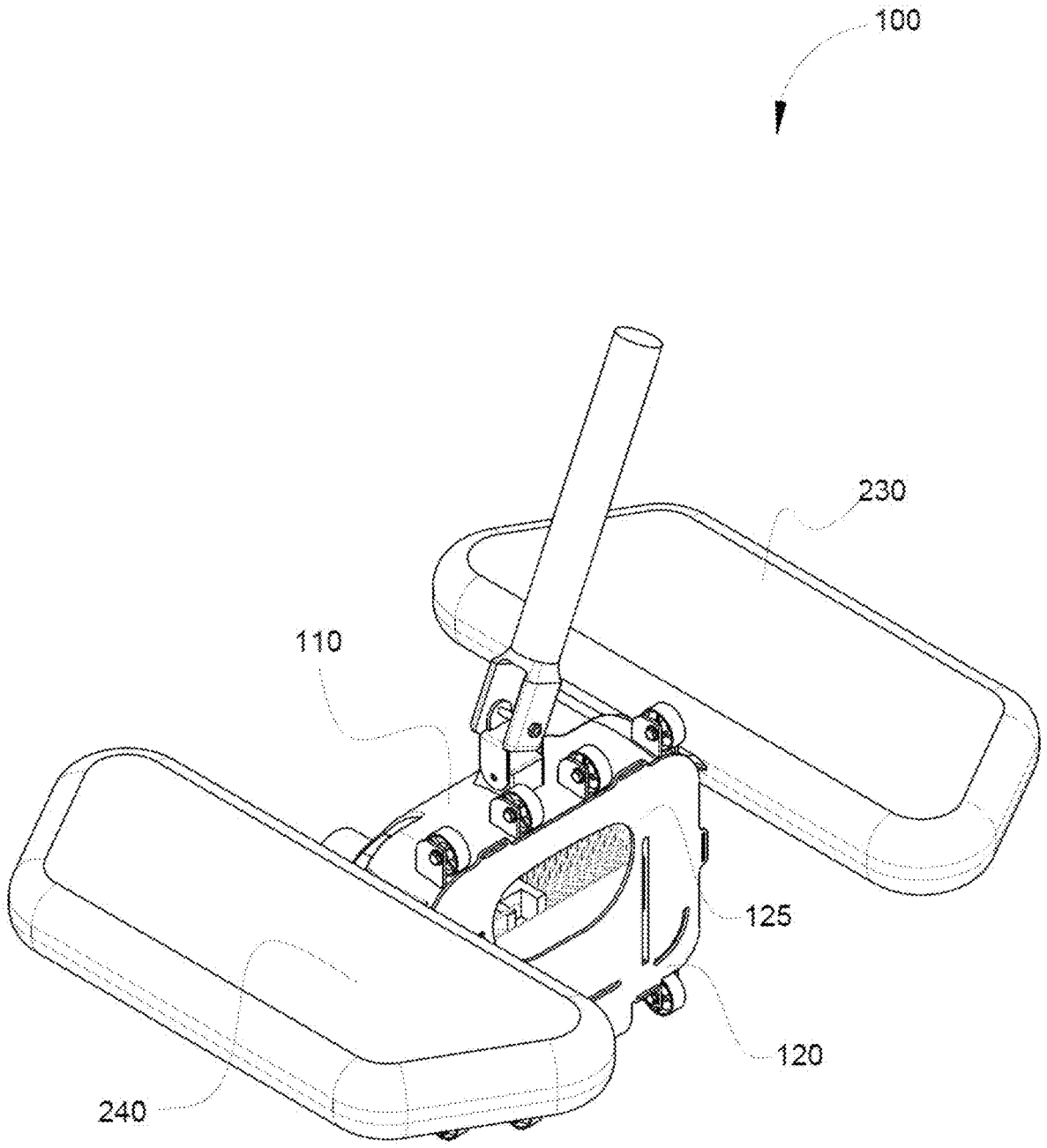
FIG. 12 is a top perspective view of the reconfigurable vacuum attachment of FIG. 6 in an in-use condition.

FIG. 12 is a top perspective view of the reconfigurable vacuum attachment 100 of FIG. 1 in an in-use condition functioning as a waterline skimmer, according to an embodiment of the present disclosure. Vacuum attachment 100 has a net positive buoyancy when the buoy is affixed to bell-shaped housing 110, and a net negative buoyancy when the buoy is detached from bell-shaped housing 110. As illustrated, when left-buoy 230 and right-buoy 240 are affixed the bell-shaped housing 110, vacuum attachment 100 is buoyant in water, such that intake-aperture 125 of faceplate 120 consistently intersects the waterline. The shape of left-buoy 230 and right-buoy 240 maintain the stability of bell-shaped housing 110 in the water such that it does not pitch in any direction and bring intake-aperture 125 out of line with the water surface.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A configurable pool scrubber and skimmer comprising a bell-shaped housing having a port releasably coupleable with a vacuum-hose, an opening opposite the port, a side-wall narrowing from the opening towards the port, a left-receiver, and a right-receiver; a faceplate releasably fastenable to the opening, the faceplate covering the opening when fastened to the opening, the faceplate comprising a planar cover, an intake-aperture perforating the planar cover enabling fluid to enter the bell-shaped housing, at least one auxiliary-aperture perforating the planar cover enabling fluid to enter the bell-shaped housing, and a door configured to selectively close, partially close, and open the intake-aperture; and two buoys, each buoy comprising a buoy-body, and a wing configured to fasten the buoy to each of the left-receiver and the right-receiver; wherein each of the left-receiver and the right-receiver comprise a cylindrical bore; and a rectangular slot intersecting an exterior of the sidewall at one end and the cylindrical bore at the other end; wherein the wing comprises a cylindrical lobe which is structured and arranged to pass into the cylindrical bore; and a rectangular cantilever affixing the cylindrical lobe to the buoy-body, the rectangular cantilever being sufficiently narrower to pass through the rectangular slot; wherein at least one of the cylindrical lobe and the rectangular cantilever is sufficiently wide to friction-fit the wing into either of the left-receiver and the right-receiver and retain the buoy to the bell-shaped housing; wherein the faceplate further comprises at least one longitudinal-slot; wherein the bell-shaped housing further comprises at least one clip configured to fasten to the at least one longitudinal slot and thereby retain the faceplate to the bell-shaped housing; wherein the faceplate further comprises a pair of tracks having sufficient relief to enable the door to slide linearly within the pair of tracks, the pair of tracks retaining the door to the faceplate; wherein the door further comprises a plurality of detent-apertures which overlap each of the pair of tracks; wherein each of the pair of tracks comprises a detent configured to penetrate into each of the plurality of detent-apertures when one of the plurality of detent-apertures aligns with the detent; wherein the configurable pool scrubber and skimmer further comprises at least one weight; wherein the bell-shaped housing further comprises a weight-receptacle configured to contain the at least one weight; and a cap configured to close the weight-receptacle; further comprising a weight-screw configured to pass through the cap and the at least one weight and fasten the cap and the at least one weight to the weight-receptacle; wherein the configurable pool scrubber and skimmer further comprises a plurality of wheels; wherein the bell-shaped housing further comprises a handle-mount; wherein the configurable pool scrubber and skimmer further comprises a handle, and at least one U-joint mechanically connecting the handle to the bell-shaped housing; wherein the configurable pool scrubber and skimmer has a net positive buoyancy when the buoy is affixed to the bell-shaped housing, and a net negative buoyancy when the buoy is detached from the bell-shaped housing; wherein the port is a cylindrical bore aligned upon an axis passing through the opening; wherein each of the buoy-bodies comprises a flat trapezoidal face configured to level the buoy with a water surface; wherein the wing is centered upon the flat trapezoidal face; wherein the at least one auxiliary-aperture includes a first-corner port, a second-corner port, and a center-port disposed between the first-corner port and the second-corner port, such that the first-corner port and the second-corner port each comprise a curved slot; and the center-port comprises a linear slot; and wherein the plurality of wheels comprises a first-set of wheels arrayed on one side of the bell-shaped housing and a second-set of wheels arrayed on an opposite side of the bell-shaped housing.

* * * * *